US006405441B1

(12) United States Patent
Rucker

(10) Patent No.: US 6,405,441 B1
(45) Date of Patent: Jun. 18, 2002

(54) WICK TRIMMER AND CAPTURE DEVICE

(76) Inventor: Julia Rucker, 5418 Teakwood Ct., Columbus, OH (US) 43229-3901

( * ) Notice: Subject to any disclaimer, the term of this patent is extended or adjusted under 35 U.S.C. 154(b) by 0 days.

(21) Appl. No.: 09/690,328

(22) Filed: Oct. 17, 2000

(51) Int. Cl.[7] ..... B26B 17/00

(52) U.S. Cl. ..... 30/179; 30/134; 30/233; 431/120; D8/57

(58) Field of Search ..... 30/131, 134, 136, 30/233, 254, 253, 186, 191, 258, 179; 431/120; D8/57

(56) References Cited

U.S. PATENT DOCUMENTS

| | | | | |
|---|---|---|---|---|
| 18,713 A | | 11/1857 | Stow et al. | |
| 36,590 A | | 9/1862 | Eagle | |
| 80,577 A | | 8/1868 | Warner | |
| 92,908 A | * | 7/1869 | Tyler | 431/120 |
| 97,776 A | | 12/1869 | Jenkins | |
| 101,066 A | * | 3/1870 | Westlake | 431/120 |
| 169,091 A | | 10/1875 | DeZeng | |
| 169,785 A | | 11/1875 | DeZeng | |
| 211,209 A | | 1/1879 | Andrews | |
| 223,027 A | | 12/1879 | Blanchard | |
| 247,888 A | * | 10/1881 | Clark | 431/120 |
| 356,319 A | | 1/1887 | Jordan | |
| 452,289 A | * | 5/1891 | Scott | 431/120 |
| 600,650 A | | 3/1898 | Powell | |
| 622,510 A | | 4/1899 | Morneau | |
| 920,822 A | | 4/1909 | Buckman | |
| 968,740 A | * | 8/1910 | Case | 431/120 |
| 2,835,032 A | | 5/1958 | Dorazio, Jr. | 30/179 |
| D275,790 S | | 10/1984 | Marlowe | D24/27 |
| 4,776,096 A | | 10/1988 | Chang | 30/233 |
| 5,035,054 A | | 7/1991 | Ellenbeger | 30/233 |
| D422,470 S | | 4/2000 | Mosca et al. | D8/57 |
| 6,076,262 A | | 6/2000 | Pappas | 30/179 |
| 6,243,954 B1 | * | 6/2001 | Bowers | 30/233 |

FOREIGN PATENT DOCUMENTS

| | | |
|---|---|---|
| FR | 2380850 | 9/1978 |

* cited by examiner

*Primary Examiner*—Hwel-Slu Payer
(74) *Attorney, Agent, or Firm*—Sean M. Casey

(57) ABSTRACT

A wick trimmer and capture device for trimming, to a predetermined length, a wick of a candle formed with a primary and a secondary wick well. The trimmer device includes an elongated, actuatable handle assembly that has a grip assembly at a proximate end and having first and second prongs at a distal end. Projecting distally from the first prong, a gauging anvil is also included that is formed with a well edge that is configured with a lateral dimension small enough to fit within the primary well and sufficient in width to span a secondary well diameter. An adjustable trim plate is slidably mounted from the second prong and is formed to have a trim blade, which is arranged in a confronting relationship with the gauging anvil.

11 Claims, 4 Drawing Sheets

WICK TRIMMER AND CAPTURE DEVICE

TECHNICAL FIELD

This invention relates to wick trimmer and capture device and more particularly to an adjustable wick trimmer that can be permanently or adjustably preconfigured to trim one or more wicks to a predetermined length, and to capture the trimmed wicks, for a variety of single and multi-wick candle and wick burning device configurations.

BACKGROUND OF THE INVENTION

For centuries, candles and other types of oil burning lamps have used wicks for purposes of providing a flame that emanates light. In recent times, and with the advent of electrically powered lighting devices, the art of candle and wick burning lamp manufacturing, and use, has developed into an industry more focused on creating artistically, aesthetically, and aromatically pleasing candles and wick burning lamps.

In commonly used present-day candles, one or more round wicks are generally situated in the center of the candle. Once ignited, the wick begins to burn and to heat the wax that surrounds the wick, which forms a molten wax pool. As the wax proximate to the wick melts, it is absorbed by the wick, and is drawn by capillary action into the flame where it is vaporized and burned into carbon dioxide, water, and other by-products. As the wax in the wick proximate to the flame burns away, more wax is drawn into the wick and up to the flame. As wax from the molten pool surrounding the wick is burned off, the flame moves down the wick. As the flame moves down the wick, it melts the surrounding wax, which flows into the molten pool. This process continues, and over time, in candles that have a large enough outside diameter, a recess develops within a wall or walls that are formed by the portion of the candle that is not burned away by the flame. In turn, the level of the molten pool of wax moves lower into the recess that forms within the candle. The recess that forms within the candle and which is surrounded by the remaining walls is termed the primary well.

As large diameter candles are burned over time, a type of chimney forms that is commonly referred to by those with skill in the art as the primary well, which forms as the wax is burned off and the wick burns down into the candle. Ideally, when candles are extinguished and reignited, they are left to burn for a period of time that is long enough so that a single well forms within the candle well or chimney. In less than ideal situations, and as is often the case with most consumers of large diameter candle products, the candle is extinguished, reignited, and reextinguished without regard to whether it has burned for the proper period of time so that only the single, primary well develops. Instead, what typically happens is that a second well forms within the primary well as the wax surrounding the burning wick slowly begins to absorb heat from the flame and melt into a pool that surrounds the wick. In time, the pool becomes large enough whereby the base diameter of the pool of molten wax normalizes and eventually equals the diameter of the primary well. However, when the candle wick is prematurely extinguished, that is, before the wax pool reaches the primary well diameter, the molten wax pool cools and hardens and leaves a secondary well that is smaller in diameter than that of the primary well. This is because the secondary well pool will have a surface that is lower than that of the primary well since wax has been burned off therefrom. Accordingly, the surface of the molten wax pool in the secondary well will not be at the same level as the base of the original primary well until the secondary well and the surrounding, unmelted wax has been fully heated and melted. After being fully heated, the secondary well walls melt and merge into the wax pool, which after sufficient time, merges into the primary well, thereby forming a new primary well and molten wax pool. As the candle is continuously reignited and extinguished, without regard for normalization of the well diameter, then tertiary and quaternary wells can also form.

In candles and other types of wick burning lamps, the wick, or a plurality of wicks, is periodically trimmed to an optimum length that eliminates unnecessary waste wick and debris, and overheating of the surrounding candle wax, chimney material, lamp components, and smoking of the burning wick, which in turn minimizes the black carbon-based soot that can emanate from such devices. Many types of wick burning lamps exist that may include, for example, an elongate chimney. The chimneys can take the form of either glass or other suitable material which surrounds the wick burning lamp or a small candle, and wherein the wick(s) are located within the chimney, usually near the bottom.

In any of the preceding configurations and situations, the wick eventually leaves a blackened waste wick and/or cast off debris that becomes ashen and no longer burns. In candles, the wick and debris often fall into the molten wax pool, which, after hardening, leaves an unsightly and aesthetically displeasing appearance to the candle. Even in other types of wick burning lamps, the unsightly debris and waste wick is aesthetically undesirable. In wick burning devices that include chimneys and in candles that have developed more than a single well, it is extremely difficult to reach into the well and to trim the wick to the proper length. Even more so, it is very difficult because of the space constraints, to capture the waste wick and debris without inadvertently casting the waste wick and debris into the molten wax pool. Even if the user waits until the wax cools and hardens before attempting to trim the wick, it is difficult, even impossible to trim the wick to the proper length because the proper length must measured from the base of the primary well, not from the base of either the secondary, tertiary, or quaternary wells.

Over the years, various attempts have been made to remedy the problems associated with waste wick and debris, and with maintaining optimum wick length in candles and other wick burning devices. Since the earliest of times in the United States, patents have issued that are directed to various types of wick maintenance devices. U.S. Pat. No. 18,713 to Stow et al. and U.S. Pat. No. 36,590 to Eagle both disclose wick trimmers that recognize the importance of trimming the wick. However, neither of these devices is suitable for purposes of the present invention. More recently, U.S. Pat. No. 6,076,262 to Pappas disclosed a wick trimmer device that is directed to trimming a wick to a predetermined length by use of a gauge device. However, this device also has shortcomings that prevent its use for purposes of the present invention.

None of the various prior art devices are suitable for use for purposes of the present invention because they each fail to either measure the wick from the proper datum, fail to be compatible for use in chimney mounted and deep well wicks, and/or they fail to capture the waste wick and debris to keep it from falling into the molten wax pool. Moreover, most present day wick trimmers are incapable of trimming a burning wick that is surrounded by a molten pool of wax. Additionally, none of the prior art device can be used in a way that avoids touching the waste wick and debris. Even more importantly, prior art devices do not keep the user from coming in contact with molten wax, which is common when individuals attempt to remove trimmed waste wick and debris from the molten wax pool as it cools.

What has been missing from the art is a device that can solve these problems without an extraordinarily complicated device, or without the need to fabricate an expensive device that does not have broad market appeal. Each of such attempts falls short of offering any motivation, suggestion, or description of a device that incorporates compatibility for use with a variety of wick burning devices, such as (1) lamps having chimneys that surround a candle, or an oil or wax burning wick, and (2) small, medium, and large diameter elongated candles that form deep primary wells over time. While the previously known devices have been able to capture a trimmed wick, they are not compatible with chimneys and deep well candles. More recent devices attempt compatibility with chimneys and deep well candles, but cannot properly trim the wick to predetermined lengths, and cannot capture waste wick and debris. Moreover, no prior art devices, neither present day nor far earlier versions can operate properly to trim a burning wick that is surrounded by a molten pool of wax. Use of the instant invention has demonstrated, in stark contrast, a significant improvement in the process of maintaining proper wick length and in ensuring that waste wick and debris is removed during the trimming process.

Without the new and novel device of the present invention, those who use candles and wick burning devices are left with the aesthetically undesirable and troublesome problems that have persisted for centuries. What has been needed but heretofore unavailable is a device that significantly improves not only the capture of waste wick and debris, but a device that also maximizes the convenience, ease, and accuracy with which candle wick trimming and capture can be accomplished. In addition to offering major advantages over the prior art, such a device must also be inexpensive to acquire, simple to operate, compatible for use in a wide range of wick burning lamps and candles, and easily manufactured so as to make the device available to the widest possible base of consumers.

The present invention meets these and other needs without adding any complexity, inefficiencies, or significant costs to use and maintenance of the most commonly wick burning lamps and candles. The various embodiments of the present invention disclosed herein are readily adapted for ease of manufacture, low fabrication costs, and immediate compatibility with such wick burning candles and lamps that are presently employed worldwide.

SUMMARY OF THE INVENTION

In general, the present invention is directed to device that is configured to trim the wicks of a wick burning device, such as an oil or wax burning lamp, a chimney-type candle sconce, and various diameter candles that, over time, form wells wherein the wick burns down and becomes difficult to trim and maintain. More specifically, the invention is directed to a wick trimmer and capture device for trimming, to a predetermined length, a wick of a candle formed with a primary and a secondary wick well. The device incorporates an elongated, actuatable handle assembly that has a grip assembly at a proximate end and first and second prongs at a distal end. A gauging anvil projects distally from the first prong and is formed with a well edge and a secondary well-spanning lateral dimension. An adjustable trim plate is slidably mounted from the second prong and is formed with a trim blade that is arranged in a confronting relationship with the gauging anvil.

In variations of this embodiment, the wick trimmer and capture device includes a handle assembly that is configured in a scissors arrangement about a pivot pin. Alternatively, the handle assembly is configured in a tong arrangement, analogous to those commonly used for serving foods and in other operations requiring remote and extended grasping of items.

In another variation of the preceding embodiment, the wick trimmer and capture device includes an adjustment mechanism that has a keyway with a slot integrally formed in the adjustable trim plate, and a screw projecting from the second prong and through the slot, and a nut for receipt onto the screw. The trim plate is slidably adjustable with respect to the gauging anvil and the second prong, and is fixed in position by tightening the nut onto the screw. In a variation of this modification, the wick trimmer device includes an adjustment mechanism that has a similar keyway with a slot integrally formed in the adjustable trim plate, and a bayonet post that projects from the second prong and through the slot. A clasp for frictional receipt onto the post is also provided. The trim plate is slidably adjustable with respect to the gauging anvil and the second prong and is fixed in position by the clasp frictionally engaging the bayonet post.

In any of the preceding embodiments, modifications, and variations, the instant invention also contemplates a configuration wherein the trim blade, trim plate, and gauging anvil are arranged to be spaced apart a distance sufficient to, when the trimmer is in a closed position, frictionally capture the trimmed wick. In another variation, the trim blade depends substantially orthogonally from trim plate to form a capture ledge, whereby the wick is captured after trimming.

In alternative variations of the preceding embodiments and varations, a wick trimmer and capture device includes, as before, an elongated, actuatable scissors handle assembly having a grip assembly at a proximate end that is pivotally mounted by a pivot pin and having first and second prongs at a distal end. Here, a slidable gauging anvil projects distally from the first prong and is mounted thereon by an adjustment mechanism. The gauging anvil is formed with a well edge and a lateral dimension that is wide enough to span the secondary well of, for example, a candle. A trim plate is also included that is mounted from the second prong and formed with a trim blade, which blade is arranged in a confronting relationship with the gauging anvil.

BRIEF DESCRIPTION OF THE DRAWINGS

Without limiting the scope of the present invention as claimed below and referring now to the drawings and figures, wherein like reference numerals and numerals with primes and double-primes across the several figures and views refer to identical, corresponding, or equivalent features parts:

DESCRIPTION OF THE PREFERRED EMBODIMENTS

Figure 1:
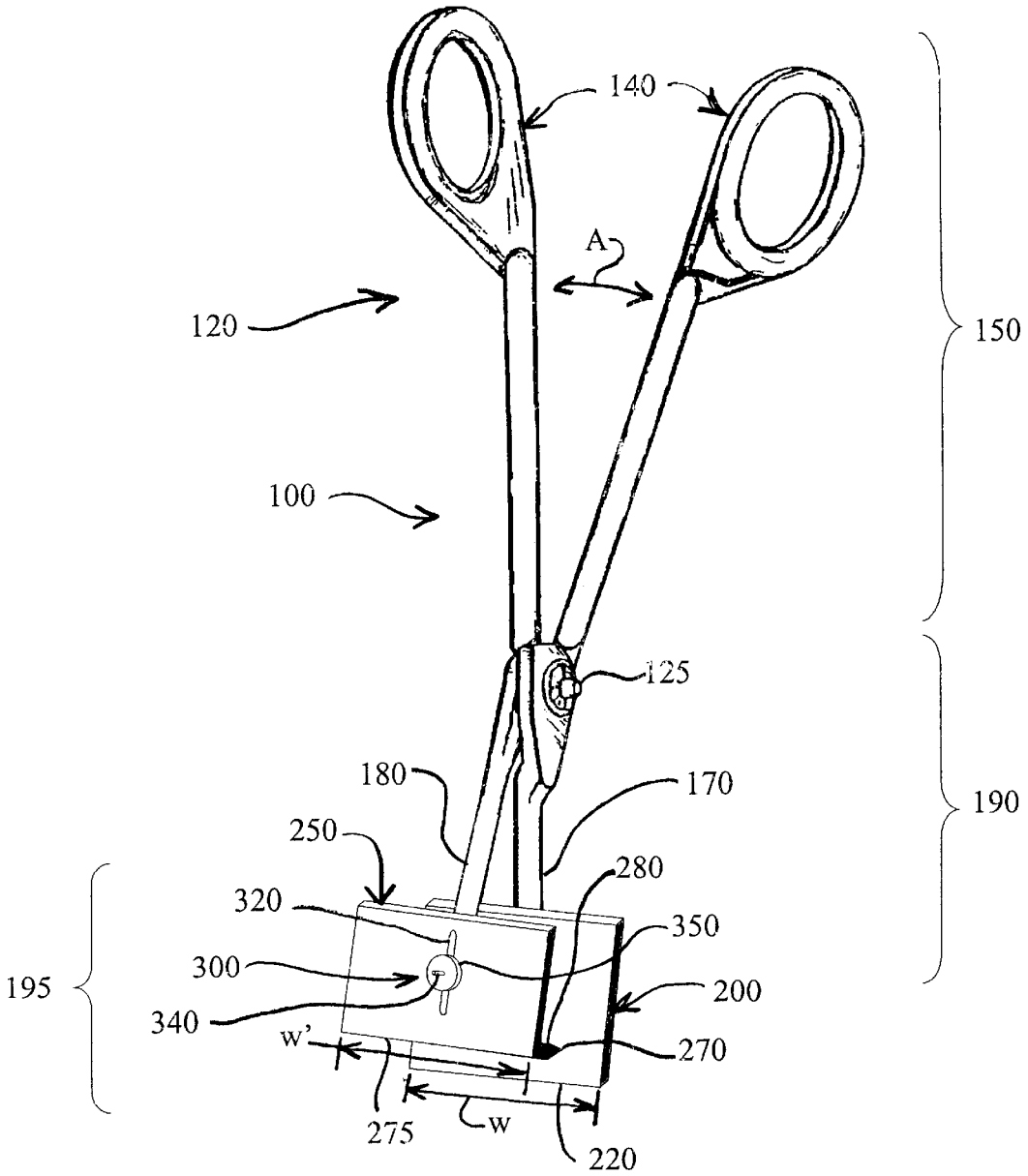
FIG. 1 a perspective view, in reduced scale, of a wick trimmer and capture device according to the present invention.

The wick trimmer and capture device according to the present invention significantly improves the ease with which an individual can trim and capture the wicks of candles and of other types of wick burning lamps during routine care. Additionally, the device according to the present invention prevents the user from ever having to come in contact with the waste wick, soot, and debris that exists on the wick, or with molten wax. Over the centuries, users of lamps have come to appreciate that maintaining proper wick length during operation can avoid unsightly lamps covered with such waste wick and debris, and can avoid emission of undesirable smoke and soot from the lamp devices.

As a candle is extinguished, reignited, and reextinguished, the secondary well may form when the wick is prematurely extinguished before the entire base of the primary well is heated to a molten state. In a similar fashion, tertiary, quaternary, etc., wells may form. In most applications, the measurement of the proper wick length is to be taken from the datum that is the base formed by the hardened wax at the bottom of the primary well, not from the base of the secondary, tertiary, and other wells. After proper trimming and capture of the waste wick and debris, the candle should be allowed to burn for a period of time whereby a molten pool of wax form around the wick that has a diameter substantially equal to that of the primary well described hereinabove.

In the most common applications where a device according to the present invention is needed, wick burning devices such as candles are not used in the most ideal manner that provides for optimum performance. For example, when the flame of the burning candle is extinguished, and the molten wax pool at the bottom of the primary well is allowed to cool, then the primary well develops a single floor or base of hardened wax. Ideally, in the use of candles, the wick is allowed to burn for a period of time that allows the entire base of the primary well to be heated into a molten state so that only a single base develops. In this case, for purposes of maintaining an ideal burn rate of wick burning lamps, the wick should be maintained to have a length of preferably between about 0.15 to about 0.50 inches, and more preferably approximately 0.25 inches, when measured from the hard wax floor of the primary well to the tip of the wick.

The most optimum length of the wick is determined on a case-by-case basis and depends upon many factors, which include, for example and without limitation, the type and grade of wax used in the candle, the diameter or cross-sectional dimensions of the candle, the diameter of the wick and the type of material used therefor, and the location of the wick or multiple wicks with respect to the cross-sectional dimensions of the candle.

In most typical applications, it is assumed that use is made of the most commonly available wick and paraffin materials in candles, and wicks in other types of wick burning lamp devices. Such devices are also presumed to incorporate a wick diameter or cross-sectional thickness of between about $1/16^{th}$ to about $3/8^{ths}$ of an inch. In these types of devices, experiences have established that an optimum burnable wick length is preferably between about 0.15 to about 0.50 inches, and more preferably to be about 0.25 inches. Preferably, this dimension is measured from the tip of the wick to the base that separates the burning wick from the non-burning wick portion, which for candles is below the surface of the molten or hardened wax base of the primary well.

In general, with reference now to the various figures and specifically to FIGS. 1, 2, 3A and 3B, the present invention is directed to device wick trimmer and capture device 100 that is configured to trim the wick(s) of a wick burning device, such as an oil or wax burning lamp, a chimney-type candle sconce, and various diameter candles that, over time, form wells wherein the wick burns down and becomes difficult to reach and trim. More specifically, the invention 100 is directed to a wick trimmer and capture device 100 for trimming, to a predetermined length, a wick of a candle formed with a primary and/or a secondary wick well. The device 100 incorporates an elongated, actuatable handle assembly 120 that has a grip assembly 140 at a proximate end 150, which are operable in a direction generally denoted by the labeled by reference letter "A", and first and second prongs 170, 180, respectively at a distal end 190. A trim and capture assembly 195 includes gauging anvil 200 projects distally from the first prong 170 and is formed with a well edge 220 and a secondary well-spanning lateral dimension, generally denoted by the reference letter "w". The gauging anvil 200 may be slidably or fixedly attached to the first prong 170 with any number of suitable means, including welding, and the adjustment mechanisms described below.

An adjustable trim plate 250 is slidably mounted from the second prong 180 and is formed with a trim blade 270 and to have a bottom edge 275 that is arranged in a confronting relationship with the gauging anvil 200 and formed with a lateral dimension, generally denoted by the reference letter w'. The dimensions denoted by reference letters "w" and w' need not be equal. The trim plate 250 slides generally in the direction depicted in FIG. 2 by the arrows generally denoted by the reference letter "B".

In another variation of the preceding embodiment, the wick trimmer and capture device 100 includes an adjustment mechanism 300 that incorporates a keyway 310 defined by a recess or groove that is adapted to cooperate with and guide the trim plate 250 as it slides on second prong 180. Within keyway 310, a slot 320 is defined that cooperates with a screw 340, that projects from the second prong 180 and through the slot 320, and a nut 350 for receipt onto the screw 340. The trim plate 250 is slidably adjustable with respect to the gauging anvil 200 and the prongs 170, 180, and is fixed in position by tightening the nut 350 onto the screw 340. In a variation of this modification, the wick trimmer device 100 includes an adjustment mechanism (not shown) that has a similar keyway with a slot, similar to keyway 310 and slot 320, integrally formed in the adjustable trim plate 250, and a bayonet post 340', similar in configuration to screw 340, that projects from the second prong 180 and through the slot, as seen in FIG. 1A. A clasp 350' for frictional receipt onto the post 340' is also provided, which can be similar in construction to the type of clasps used to secure earrings by those having a pierced ear, wherein the clasp slides onto the bayonet type post. The trim plate 250 is slidably adjustable with respect to the gauging anvil 200 and the prongs 170, 180, and is fixed in position by frictionally engaging the clasp 350' onto the bayonet post 340'. Alternatively, adjustability is not required, and the trim plate 250 can be fixedly mounted to the prong 180 whereby a predetermined wick length can be obtained upon operation and trimming.

Figure 1A:
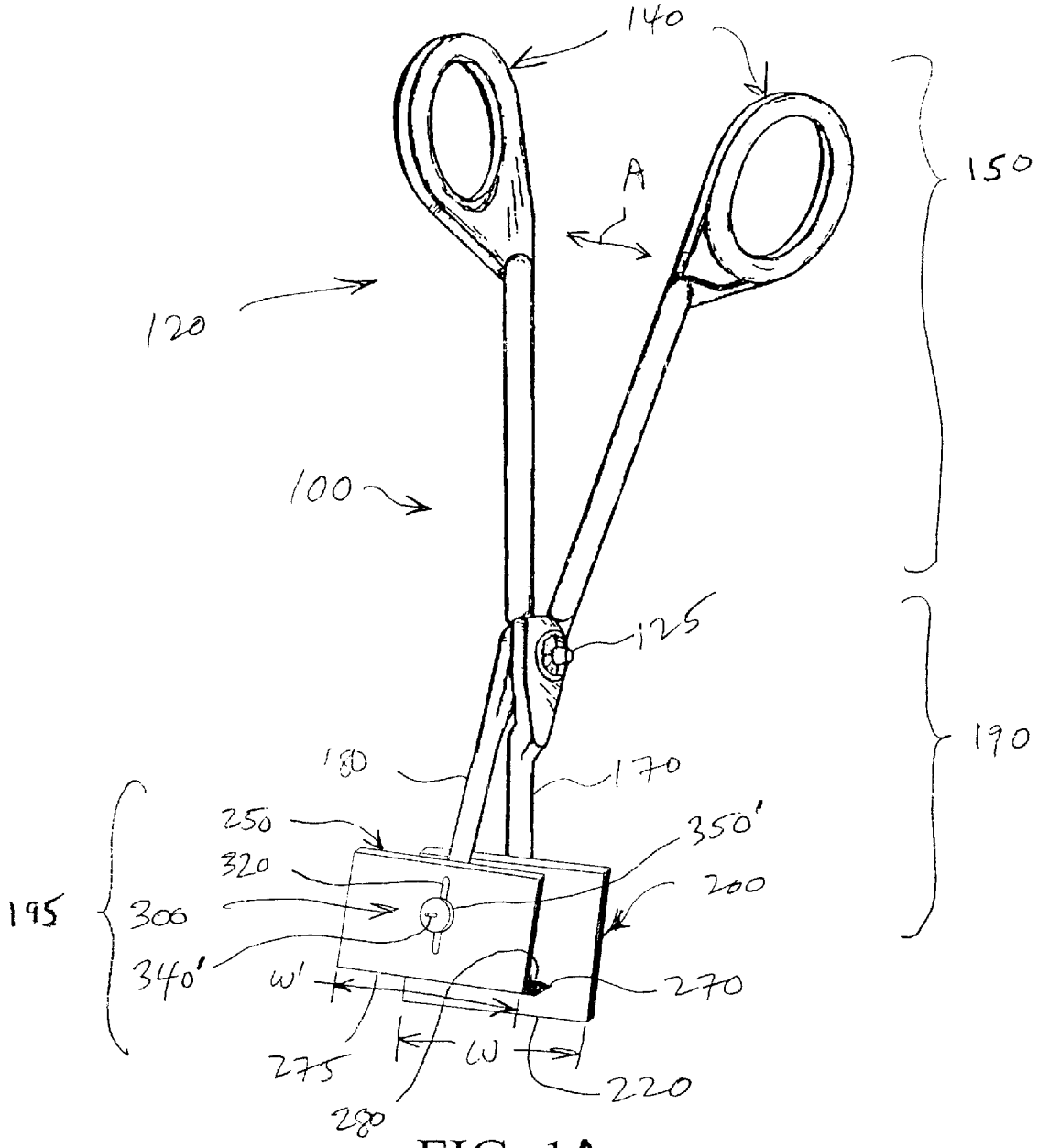
FIG. 1A perspective view, in reduced scale, of a variation of the wick trimmer and capture device according to the present invention.
Figure 2:
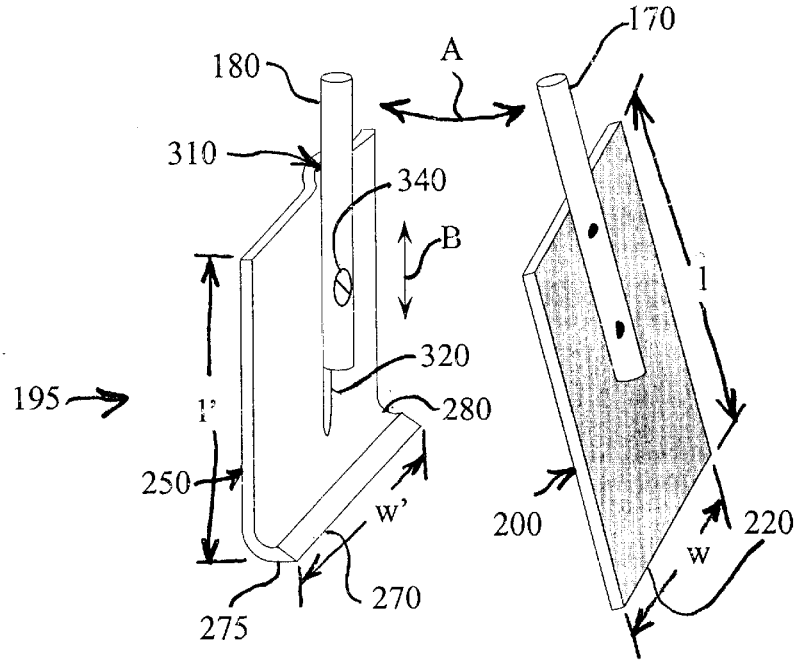
FIG. 2 is a rotated detail view, in enlarged scale, of the distal end of the wick trimmer and capture device of FIG. 1 and showing the trim and capture assembly in detail.
Figure 3A:
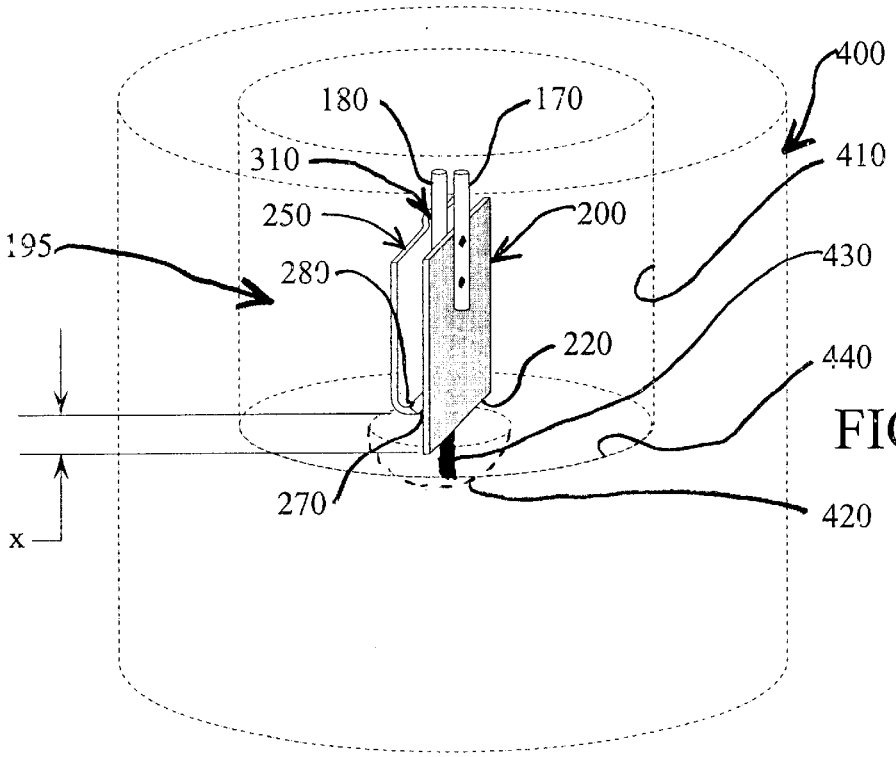
FIG. 3A is a detail view, in reduced scale, of the wick trimmer and capture device of FIGS. 1 and 2 in operation and trimming the wick of a candle or wick burning lamp.
Figure 3B:
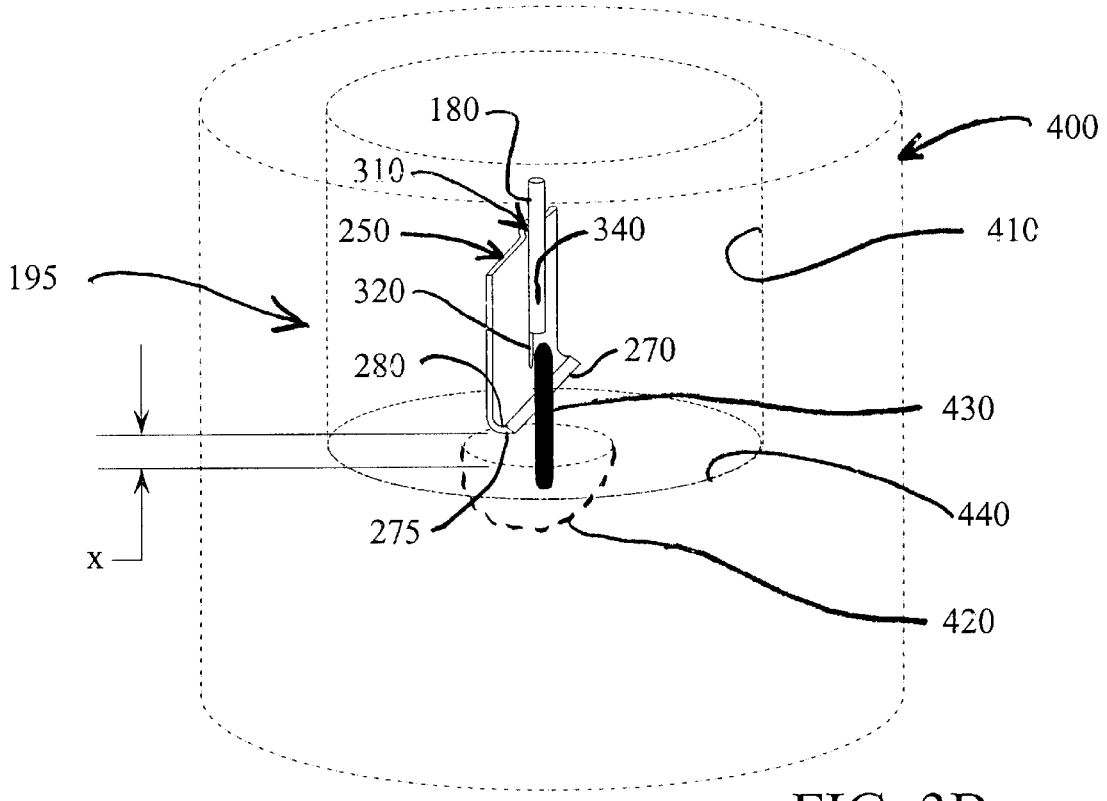
FIG. 3B is a detailed view, in reduced scale, of the wick trimmer and capture device of FIG. 3A with a portion of the device removed for clarity and illustration purposes.

With particular reference now to FIGS. 1, 3A and 3B, it can be understood that the device according to the present invention is directed to use with, among other wick burning devices, for purposes of illustration but not limitation, a candle 400 that has been used for a period of time wherein a primary well 410 and a secondary well 420 have formed. Preferably, the wick trimmer and capture device 100, is configured whereby the gauging anvil 200 includes the secondary well-spanning lateral dimension "w" that is sufficient to span the diameter of the secondary well 420. Moreover, the trim plate 250 and the gauging anvil 200 are configured to have a vertically oriented dimensions l' and l (denoting the lowercase letter "L"), respectively, which can be any suitable dimension that is compatible for use as described herein.

The trim plate 250 can be configured with any of a wide variety of suitable shapes and blade 270 dimensions whereby the wick of a candle can be engaged thereby. Although the figures generally depict a substantially rectangularly shaped trim plate 250 and anvil 200, the device according to the present invention will be equally effective if chamfered or curvilinear configurations are used. In the preferred configuration, the device 100 includes a gauging anvil 200 that is formed to have a dimension w and that is preferably substantially between approximately ½ to about 1½ inches, and more preferably approximately, 1 inch. The trim plate 250 and/or trim blade 270 are formed to have a dimension w' that may, but need not, have a dimension similar to that of the gauging anvil 200. The trim plate 250 and/or blade 270 need only have a sufficient width to grasp, trim, and capture the wick 430 to be trimmed. In this, configuration, the wick trimmer and capture device 100 of the present invention will be compatible for use with the widest array of existing candle and wick burning devices, including those that incorporate a chimney and the like.

Preferably, in operation when the trimmer and capture device 100 is operated to trim and capture a wick, such as candle wick 430, the handle assembly 120 is positioned to put the trim plate 250 and the gauging anvil 200 in proximity to the candle wick 430, wherein the well edge 220 is placed upon the bottom base 440 of the primary well 410 so that it spans the secondary well 420. Prior to placement, the trim plate 250 and trim blade 270 are adjusted to achieve the preferred wick length, as described in more detail herein. Next, the grips 140 are compressed to trim and capture the wick 430. As the trim plate 250 and gauging anvil 200 approach one another, the wick 430 is trimmed and captured therebetween. This capture technique avoids contact by the user with the waste or trimmed wick, and associated carbon deposits and debris, and keeps such from falling into the well(s) of the candle 400, or onto the surfaces of various other types of wick burning devices.

To further elaborate with reference now to FIGS. 3A and 3B, the desired length of wick 430 is obtain whereby the trimmer and capture device 100 is adjusted so that the bottom edge 275 of the trim blade 270 is positioned at the desired wick trim length, which is measured on the trim and capture assembly 195 from the well edge 220 of the gauging anvil 200 to the bottom edge 275 of the trim plate 250, which, as shown in the various illustrative figures, is coplanar with the cutting edge of the trim blade 270. Coplanarity is not required for effective operation of the present invention. Accordingly, when configured for purposes of trimming the wick 430 to, for example, have a length of ¼ inch, the bottom edge 275 will be approximately ¼ inch above the bottom base 440 of the primary well 410 when well edge 220 is placed on the bottom base 440 thereof. This arrangement is further generally illustrated by the dimension labeled in the various figures as "X".

Although not shown in the various figures, those having skill in the art will appreciate that any of the various components of the trimmer and capture device 100 may be inscribed with indicia that indicate proper adjustment positioned of, for example but not limitation, the gauging anvil 200 and trim plate 250. For example, the gauging anvil 200 may incorporate indicia that will allow convenient adjustment of the trim blade 270 of the plate 250 whereby the blade 270 can be aligned with indicia inscribed on the confronting surface of the anvil 200. As a further illustration, indicia can be imprinted that denote the proper position for obtaining a wick length of either ¼ inch or ½ inch, or both.

Figure 4:
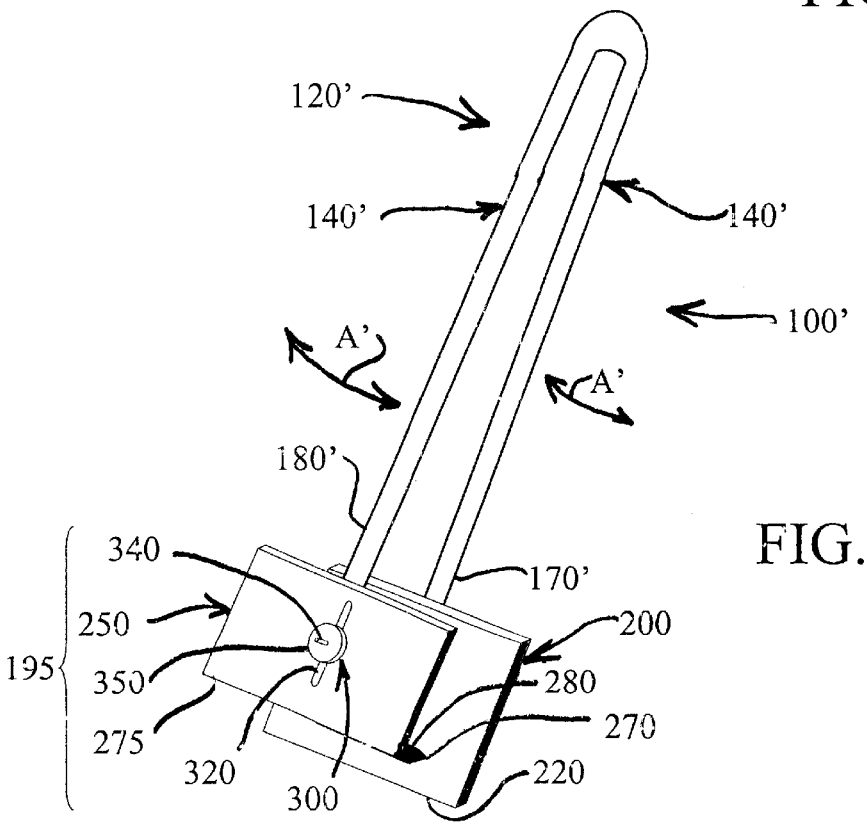
FIG. 4 is a perspective view, in reduced scale, of a variation of the wick trimmer and capture device according to the present invention.

In variations of this embodiment, the wick trimmer and capture device 100 includes a handle assembly 120 that is configured in a scissors arrangement about a pivot pin 125, as can be best appreciated with reference generally to FIG. 1, the direction of motion arrows denoted generally by reference letter "A". Alternatively, as can be understood with reference to FIG. 4, the modified device 100' includes, in addition to many of the preceding elements, a handle assembly 120' that is configured in a tong arrangement, analogous to those commonly used, for example but not limitation, in food serving applications. The tong arrangement is operated in a direction generally denoted by arrows depicted in FIG. 4 and labeled by the reference letters A'. In this embodiment, and with reference also to FIGS. 1–3; grip assembly 140' is somewhat similar to grip assembly 140, and prongs 170', 180' are similar to prongs 170, 180.

In any of the preceding embodiments, modifications, and variations, and with continued reference to FIGS. 1–4, the instant invention also contemplates a configuration wherein the trim blade 270, trim plate 250, and gauging anvil 200 are arranged to be spaced apart a distance sufficient to trim, enclose, and/or frictionally capture the waste wick, when the trimmer 100 and the trim and capture assembly 195 are in a closed position; which can be understood with general reference to the figures including especially FIGS. 3A and 3B. In another variation, the trim blade 270 depends substantially orthogonally from trim plate 250 to form a capture ledge 280, whereby the wick 430 is trimmed, enclosed, and/or frictionally captured after trimming.

In alternative variations of the preceding embodiments and varations, a wick trimmer and capture device 100 includes, as before, an elongated, actuatable scissors handle assembly 120 having with a grip assembly 140 at a proximate end 153 that is pivotally mounted by a pivot pin 125 and having first and second prongs 170, 180, respectively, at a distal end 190. Here, a slidable gauging anvil, similar to anvil 200 but not shown, projects distally from the first prong 170 and is mounted thereon by an adjustment mechanism, which, for example but not limitation, can be similar to the adjustment mechanisms described above, including mechanism 300. The gauging anvil is formed with a well edge, such as edge 220, and a lateral dimension, similar to dimensions w and/or w', that is wide enough to span the secondary well 420 of, for example, a candle such candle 400. A trim plate, such as trim plate 250, is also included that is mounted from the second prong 180 and formed with a trim blade 270, which blade 270 is arranged in a confronting relationship with the gauging anvil.

The present invention establishes a significant advance over the previously known wick trimming and capture devices and methods for their use, and the advance is achieved with minimum cost, simplicity of fabrication, and compatibility with a wide variety of wick burning devices and candles.

Numerous modifications and variations of the preferred embodiments disclosed herein will be apparent to those skilled in the art. For example, although specific embodiments have been described in detail, those with skill in the art will understand that the preceding embodiments and variations can be modified to incorporate various types of substitute and/or additional materials and dimensional configurations for compatibility with the wide variety of equipment available in the industry. Accordingly, even though only few variations of the present invention are described herein, it is to be understood that the practice of these additional modifications and variations and the equivalents thereof, are within the spirit and scope of the invention as defined in the following claims.

I claim:

1. A wick trimmer and capture device for trimming, to a predetermined length, a wick of a candle formed with a primary wick well and a secondary wick well, comprising:

an elongated, actuatable handle assembly with a grip assembly at a proximate end and having first and second prongs at a distal end;

a gauging anvil projecting distally from the first prong and formed with a well edge having a secondary well-spanning lateral dimension; and an adjustable trim plate slidably mounted from the second prong and formed with a trim blade arranged in a confronting relationship with the gauging anvil.

2. The wick trimmer and capture device according to claim 1, wherein the handle assembly is configured in a scissors arrangement about a pivot pin.

3. The wick trimmer and capture device according to claim 1, wherein the handle assembly is configured in a tong arrangement.

4. The wick trimmer and capture device according to claim 1, wherein the device includes an adjustment mechanism that has a keyway with a slot integrally formed in the adjustable trim plate, and a screw projecting from the second prong and through the slot, and a nut for receipt onto the screw, whereby the trim plate is slidably adjustable with respect to the gauging anvil and the second prong and fixed in position by tightening the nut onto the screw.

5. The wick trimmer and capture device according to claim 1, wherein the device includes an adjustment mechanism that has a keyway with a slot integrally formed in the adjustable trim plate, and a bayonet post projecting from the second prong and through the slot, and a clasp for frictional receipt onto the post, whereby the trim plate is slidably adjustable with respect to the gauging anvil and the second prong and fixed in position by the clasp frictionally engaging the bayonet post.

6. A wick trimmer and capture device for trimming, to a predetermined length, a wick of a candle formed with a primary wick well and a secondary wick well, comprising:

an elongated, actuatable scissors handle assembly including a grip assembly at a proximate end pivotally mounted by a pivot pin and having first and second prongs at a distal end;

a gauging anvil projecting distally from the first prong and formed with a well edge having a secondary well-spanning lateral dimension; and a trim plate slidably mounted from the second prong by an adjuster mechanism and formed with a trim blade arranged in a confronting relationship with the gauging anvil.

7. The wick trimmer and capture device according to claim 6, wherein the trim blade, the trim plate, and the gauging anvil are arranged to be spaced apart a distance sufficient to, when the device is in a closed position, capture the trimmed wick.

8. The wick trimmer device according to claim 6, wherein the trim blade depends substantially orthogonally from the trim plate to form a capture ledge, whereby the wick is captured after trimming.

9. A wick trimmer and capture device for trimming, to a predetermined length, a wick of a candle formed with a primary wick well and a secondary wick well, comprising:

an elongated, actuatable scissors handle assembly having a grip assembly at a proximate end pivotally mounted by a pivot pin and having first and second prongs at a distal end;

a slidable gauging anvil projecting distally from the first prong and mounted thereto by an adjustment mechanism and formed with a well edge having a secondary well-spanning lateral dimension; and a trim plate mounted from the second prong and formed with a trim blade arranged in a confronting relationship with the gauging anvil.

10. The wick trimmer and capture device according to claim 9, wherein the trim blade, the trim plate, and the gauging anvil are arranged to be spaced apart a distance sufficient to, when the device is in a closed position, capture the trimmed wick.

11. The wick trimmer and capture device according to claim 9, wherein the trim blade depends substantially orthogonally from the trim plate to form a capture ledge, whereby the wick is captured after trimming.

* * * * *